US005698079A

United States Patent [19]

Grönvold-Hansen et al.

[11] Patent Number: 5,698,079

[45] Date of Patent: Dec. 16, 1997

[54] ARRANGEMENT FOR SPREADING PAPER PULP IN A CONTAINER

[75] Inventors: Christen Grönvold-Hansen; Rolf Ekholm, both of Karlstad, Sweden

[73] Assignee: Kvaerner Pulping Technologies AB, Karlstad, Sweden

[21] Appl. No.: 591,441

[22] PCT Filed: Aug. 12, 1994

[86] PCT No.: PCT/SE94/00737

§ 371 Date: Jan. 29, 1996

§ 102(e) Date: Jan. 29, 1996

[87] PCT Pub. No.: WO95/08020

PCT Pub. Date: Mar. 23, 1995

[30] Foreign Application Priority Data

Sep. 16, 1993 [SE] Sweden ..... 9303019

[51] Int. Cl.[6] ..... D21C 7/08

[52] U.S. Cl. ..... 162/246; 162/17; 162/52; 141/286; 239/681; 239/687

[58] Field of Search ..... 162/17, 52, 246; 141/286; 239/681, 687

[56] References Cited

U.S. PATENT DOCUMENTS 3,315,823 4/1967 Rikoff ..... 239/687

*Primary Examiner*—Donald E. Czaja
*Assistant Examiner*—Steven B. Leavitt
*Attorney, Agent, or Firm*—Cushman Darby & Cushman IP Group Of Pillsbury Madison & Sutro LLP

[57] ABSTRACT

The present invention relates to an arrangement for spreading paper pulp in a container for storing or treating the pulp, which arrangement comprises an inlet for supplying the pulp to a rotatably mounted spreader wheel and a driving member for driving said spreader wheel. The spreader wheel is provided with spreader blades, where each spreader blade has a surface which is directed towards the direction of rotation and is shaped to transport and spread the pulp outwards towards the periphery of the container during rotation of the spreader wheel. A spreader shield is arranged to divert a part of the outwardly directed pulp towards the center of the container so that the pulp is essentially spread over the entire cross-sectional area of the container.

9 Claims, 3 Drawing Sheets

ARRANGEMENT FOR SPREADING PAPER PULP IN A CONTAINER

This application claims benefit of international application PCT/SE94/00737, filed Aug. 12, 1994.

FIELD OF THE INVENTION

The present invention relates to an arrangement for spreading paper pulp in a container for storing or treating the pulp, which arrangement comprises a spreader wheel, rotatably mounted in the container, with spreader blades, a driving member for driving said spreader wheel and an inlet for supplying the pulp to said spreader wheel.

An arrangement according to the for spreading material is already known from U.S. Pat. No. 3,053,069. This arrangement relates to a bleaching tower, and more specifically to an arrangement for feeding paper pulp to the tower, a supply line for pulp opening inside the tower at its bottom. The arrangement comprises a wheel mounted on a drive shaft for distributing the pulp all around the bottom of the tower. The arrangement thus injects the pulp from the mouth along an annular path in which no radial distribution of the pulp takes place and is not necessary either.

In U.S. Pat. No. 3,053,067, a further arrangement for feeding paper pulp to a bleaching tower is shown and described, which is also mounted in the bottom of the bleaching tower and comprises pipes opening into the bleaching tower, from which the pulp is fed during rotation.

SUMMARY OF THE INVENTION

The aim of the present invention is to produce an arrangement of the type indicated in the introduction, which will distribute the pulp essentially over the entire cross-sectional area of the container.

A further aim of the invention is that the arrangement will be simple and reliable in its function.

The aims are achieved by means of an arrangement which has been given the characteristics which emerge from following description.

Preferred embodiments of the arrangement according to the invention have moreover been given one or more of the characteristics emerging from the description.

The arrangement for spreading pulp is thus intended principally for storage towers, buffer tanks or reactors. The arrangement is intended to be mounted at the top in the center of the container. The arrangement is constructed in such a manner that it can distribute the pulp evenly over the entire cross-sectional area of the container which my be a tower, a tank or a reactor. By even spreading of the pulp over the cross-sectional area, an even feeding-out rate (plug flow) is achieved, as a result of which the risk of canalizing is eliminated.

BRIEF DESCRIPTION OF THE DRAWINGS

The invention is described in greater detail below with reference to the attached drawings, which show a preferred embodiment.

DETAILED DESCRIPTION OF THE INVENTION

Figure 1:
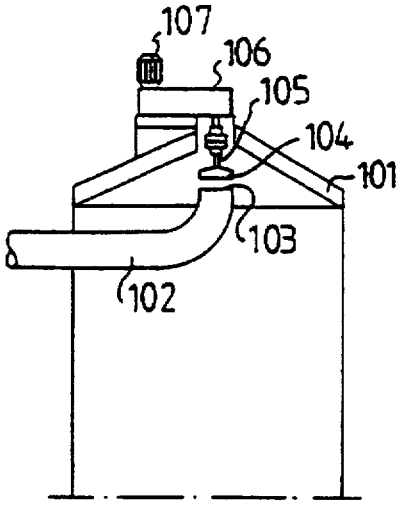
FIG. 1 shows a partial cross-section through the upper part of a container for treating paper pulp with a first embodiment of a distributing arrangement according to the invention mounted thereon.
Figure 2:
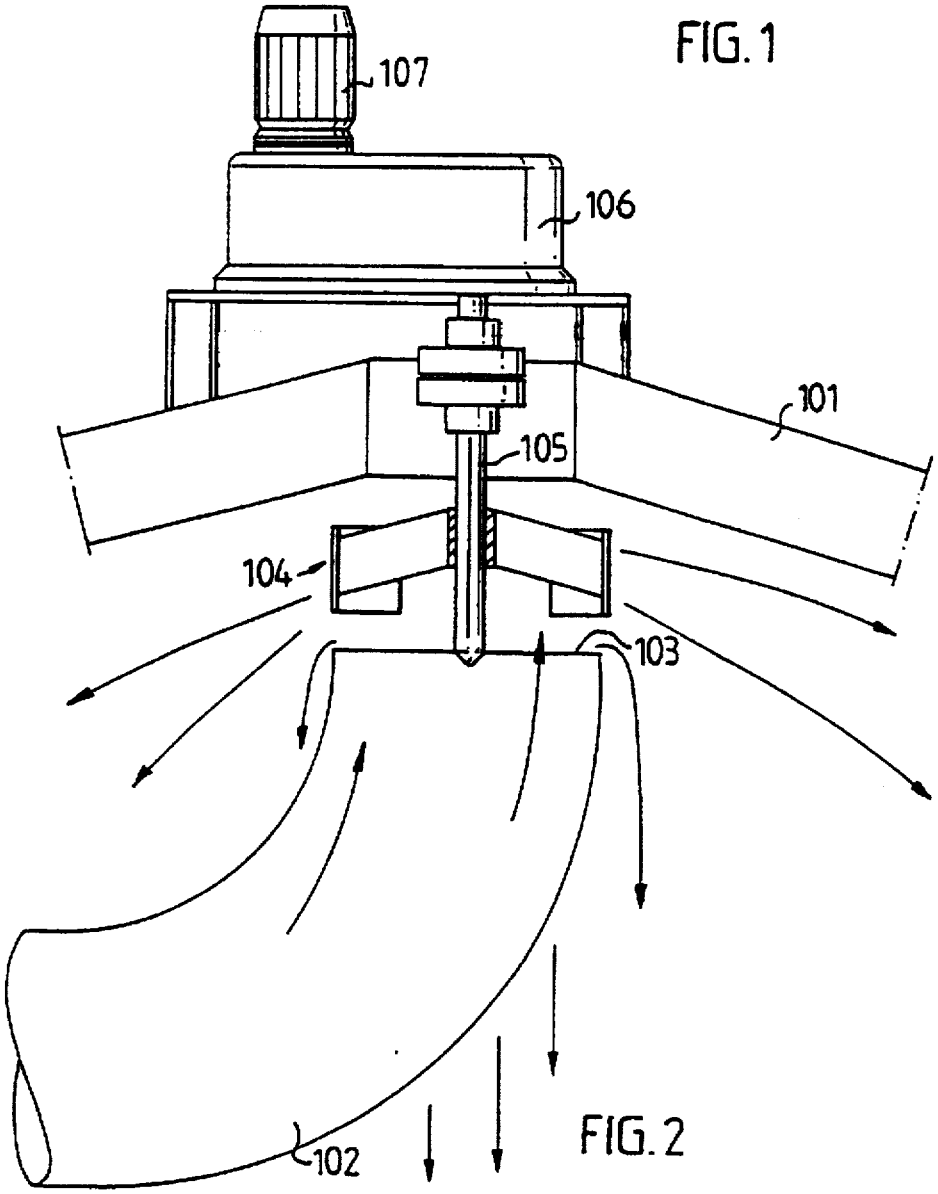
FIG. 2 shows a detail of the view in FIG. 1 on an enlarged scale.

In FIGS. 1 and 2, a first embodiment of a distributing arrangement according to the invention is shown, mounted in the upper part of a container 101 for storing or preparing paper pulp. The pulp is supplied to the container 101, which can consist of a storage tower, a buffer tank, a reactor or the like, through a line 102 which opens with an upwardly directed inlet 103 (overflow) at the top in the container. A spreader wheel 104 is rotatably mounted on a drive shaft 105 which in the exemplary embodiment shown is mounted in the upper part of the container 101 and is driven via a transmission 106 by a motor 107.

Figure 3:
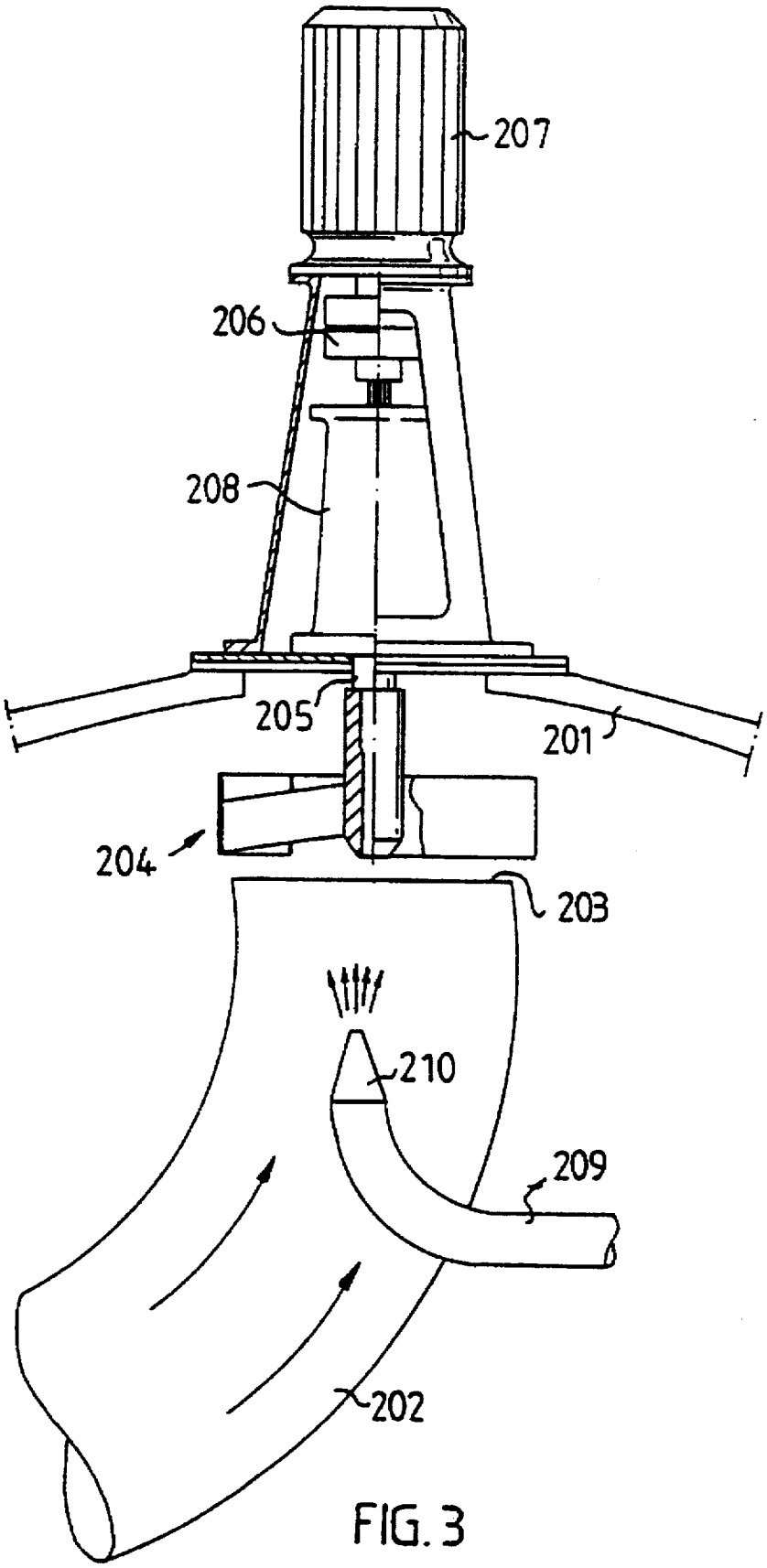
FIG. 3 shows a partial cross-section through the upper part of a container for treating paper pulp with a second embodiment of a distributing arrangement according to the invention mounted thereon.

In FIG. 3, a second embodiment of a distributing arrangement according to the invention is shown, mounted in an upper part of a container 201 similar to that in FIGS. 1 and 2 for storing or preparing paper pulp. The pulp is supplied through a line 202 which opens with an upwardly directed inlet 203 (overflow) at the top in the container. A spreader wheel 204 is rotatably mounted on a drive shaft 205 which in the exemplary embodiment shown is mounted in the upper part of the container 201 and is driven via a coupling 206 of a frequency-controlled motor 207. The drive shaft is mounted in a bearing housing 208 arranged between the wheel 204 and the coupling 206. With a frequency-controlled motor, the speed of the wheel 204 can be varied so that different spreading rates of the pulp are achieved. A line 209, which opens in a mouthpiece 210, is mounted so that the mouthpiece opens in the line 202 and is preferably directed towards the inlet 203. The spreader wheel 204 can in this case be used for distributing an additive, such as chemicals or other liquids, to the pulp situated in the container. This distribution can take place either directly above the pulp in the container or together with pulp on distribution of the same in the container. Such chemicals, which may possibly be added via the line 209, are foam quenchers such as EDTA (complexing agent), bleaching agents such as peroxide (e.g. $H_2O_2$), or pH adjusters such as NaOH or $H_2SO_4$, etc. It should also be possible for the mouthpiece to be rotatable or a number of lines with mouthpieces can be arranged along the line 202 in order to be able to offer an earlier mixing of the additive in the pulp. It is also possible to connect the line 209 directly, for example from underneath, to the hub of the spreader wheel so that the additive is added directly via openings (not shown) arranged in the spreader wheel.

Figure 4:
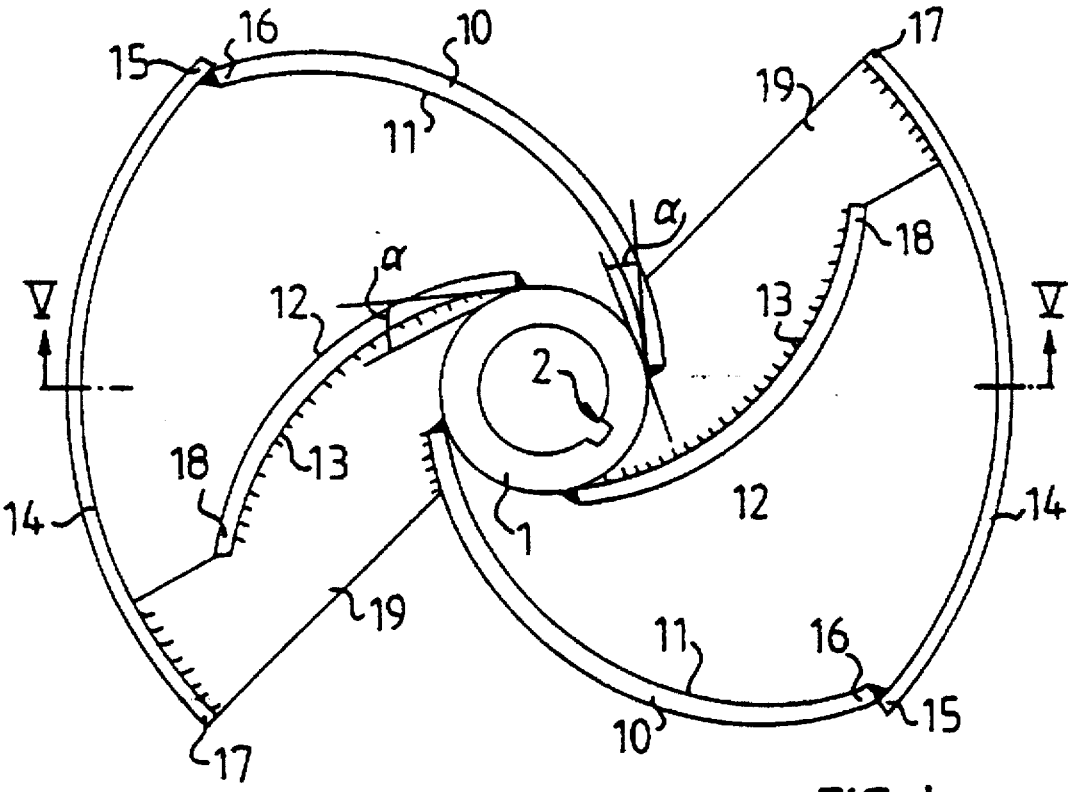
FIG. 4 shows a top view of the arrangement according to the invention.
Figure 5:
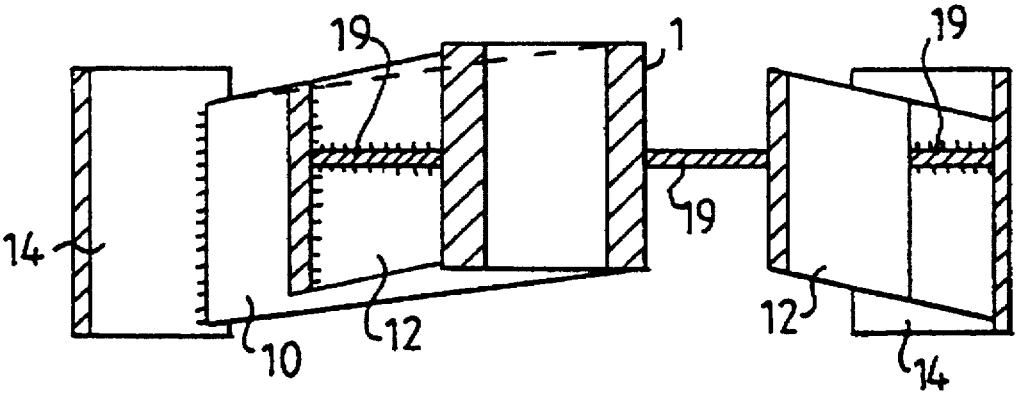
FIG. 5 shows a cross-section along line V—V in FIG. 4.

The spreader wheel 104 or 204 respectively, which is described in greater detail with reference to FIGS. 3 and 4, comprises a hub 1 which is mounted in a fixed manner on the drive shaft 105 or 205 respectively, preferably by means of a wedge joint at 2. First spreader blades or vanes 10, which preferably have a surface 11 which is arched towards the direction of rotation, are mounted on the drive shaft at an angle $\alpha$ to the tangent on the outer surface of the hub so that the pulp is spread outwards towards the periphery of the container. Second spreader blades or vanes 12, which also preferably have a surface 13 arched towards the direction of rotation, are mounted on the drive shaft at preferably the same angle $\alpha$. The angle $\alpha$ should be selected so that a suitable spreading of the pulp in the direction radially outwards is achieved depending upon the shape of the surfaces 11 and 13 which consequently should be arched but can also have a different shape, for example plane. The first and second spreader blades 10 and 12 are mounted in pairs on the hub so that the second spreader blade 12, which—in order to avoid build-up of fibres can be shorter than the first spreader blade 10, is preferably placed in front of the first spreader blade 10, seen in the direction of rotation. In the drawing, there are two pairs of spreader blades shown on one hub 1, but this number can of course be varied within the scope of the attached patent claims.

Each spreader blade 10, 12 thus has a surface 11 or 13, respectively, which is directed towards the direction of rotation and which is shaped and mounted relative to the hub in order to transport and spread the pulp outwards towards the periphery of the container during rotation of the wheel 104 or 204 respectively. This surface 11, 13 has a curvature with a radius which lies between 100–300 mm, and preferably between 150–200 mm.

In order also to distribute the pulp towards the centre of the container 101/201, a spreader shield 14 is arranged, one end 15 of which can be connected to the outer end 16 of the first spreader blade 10. Each spreader shield extends in a circular path in the direction of rotation with the centre in the centre of the hub 1 so that the other end 17 of the shield 14, preferably by means of the second spreader blade 12, consequently comes to divert the pulp so that it is spread and distributed towards the centre of the container, a distribution of the pulp over the cross-sectional area of the container being achieved.

An essentially radially directed reinforcing plate 19 connects the spreader shield 14 to the outer end 18 of the second spreader blade 12. This reinforcing plate is thus placed essentially half-way between the upper and lower edges of the spreader blades on the side of the second spreader blade 12 facing towards the direction of rotation in order to give a better stability to the spreader blades 10 and 12 and the spreader shield 14 during operation.

The inlet 103/203 opens out directly under the wheel 104/204, as a result of which the pulp flowing out of the inlet is sliced off and thrown out and spread evenly over the cross-sectional area of the tower. The speed of the spreader wheel and the vertical distance between spreader wheel and the mouth of the pulp pipe are adapted to ensure evenness in the distribution.

The parts which form the spreader wheel are preferably made of metal and welded to one another. In a preferred exemplary embodiment, the outer diameter of the spreader wheel 104/204 is approximately 100 mm greater than the diameter of the mouth of the pulp inlet 103/203. Within the scope of the attached patent claims, the spreader wheel can be mounted and driven in the upper part of the container in other ways known per se.

The arrangement according to the invention, which has been described above with reference to the embodiment shown in the drawings, can of course be modified within the scope of the attached patent claims with regard to the description and the drawings.

I claim:

1. In an arrangement for spreading paper pulp in a container for storing or treating the pulp, which arrangement comprises an inlet for supplying the pulp to a rotatably mounted wheel and a driving member for driving said spreader wheel, the improvement comprising said spreader wheel being provided with spreader blades each having a distal end and a surface which faces in the direction of rotation and being shaped to transport and spread the pulp outwardly towards the periphery of the container during rotation of the spreader wheel, said spreader wheel comprising at least one spreader shield disposed at the periphery of the spreader wheel and extending in the direction of rotation of said spreader wheel to distribute a part of the outwardly directed pulp towards the center of the container so that the pulp is spread over the entire cross-sectional area of the container, each spreader shield being fixed to said distal end of each said spreader blade.

2. Arrangement according to claim 1, wherein an additional one of said spreader blades (12) is arranged radially inside the spreader shield and is shorter than the spreader blade (10) fixed to the spreader shield.

3. Arrangement according to claim 1, wherein said spreader wheel is mounted at the top in the container and in that said surface (11,13) of the spreader blades (10,12) is arched.

4. Arrangement according to claim 3, wherein said surface (11,13) has a curvature with a radius which lies in the interval 100–300 mm.

5. Arrangement according to claim 3, wherein said surface has a curvature with a radius which lies in the interval of 150–200 mm.

6. Arrangement according to one of claim 1 wherein said surface (11,13) extends in a spiral shape in the horizontal plane from a drive shaft (105;205), on which said spreader wheel (104;204) is mounted.

7. Arrangement according to claim 6 wherein said spreader wheel comprises at least one reinforcing plate (19), which is fixed on spreader blades (10,12) arranged in pairs and the spreader shield (14).

8. Arrangement according to claim 7, wherein said reinforcing plate (19) is placed substantially half-way between the upper and lower edges of the spreader blades (10,12).

9. Arrangement according to claim 8, wherein said spreader wheel comprises a line (209) for mixing an additive into the pulp which is to be distributed and in that said line can be mounted in the inlet (203;204) for direct supply into the pulp before distribution.

* * * * *